US005712459A

United States Patent [19]

Ziegler

[11] Patent Number: 5,712,459

[45] Date of Patent: Jan. 27, 1998

[54] PUSH-TYPE SWITCH IN PARTICULAR WITH EXTENDED PUSH COMPONENT

[75] Inventor: Wolfgang Ziegler, Karlsbad, Germany

[73] Assignee: Valeo Borg Instruments GmbH & Co. KG, Remchingen, Germany

[21] Appl. No.: 501,438

[22] Filed: Jul. 12, 1995

[30] Foreign Application Priority Data

Jul. 16, 1994 [DE] Germany ..... 44 25 154

[51] Int. Cl.[6] ..... H01H 9/00

[52] U.S. Cl. ..... 200/5 R; 200/17 R; 200/343

[58] Field of Search ..... 200/5 R, 5 A, 200/4, 512–517, 520–560, 293–307, 308–317, 341, 342, 343, 344, 345, 17 R

[56] References Cited

U.S. PATENT DOCUMENTS

| | | | |
|---|---|---|---|
| 3,582,594 | 6/1971 | Twyford | 200/341 |
| 3,720,801 | 3/1973 | Yanaga | 200/330 |
| 4,139,756 | 2/1979 | Tsen et al. | 200/330 |
| 4,286,127 | 8/1981 | Quitoschinger | 200/83 J |
| 4,354,079 | 10/1982 | Yoshimura | 200/314 |
| 4,359,612 | 11/1982 | Rooney | 200/5 R |
| 4,376,237 | 3/1983 | Long | 200/61.27 |
| 4,544,811 | 10/1985 | Brevick | 200/5 R |
| 4,565,989 | 1/1986 | Lotter et al. | 337/311 |
| 4,990,730 | 2/1991 | Shinohara et al. | 200/314 |
| 5,107,084 | 4/1992 | Ueno et al. | 200/343 X |
| 5,140,293 | 8/1992 | Fournier et al. | 200/342 |
| 5,188,220 | 2/1993 | Schmitt-Walter | 200/343 |

FOREIGN PATENT DOCUMENTS

| | | | |
|---|---|---|---|
| 0 094 066 | 11/1983 | European Pat. Off. | H01H 13/14 |
| 0 304847 | 1/1989 | European Pat. Off. | H01H 3/12 |

OTHER PUBLICATIONS

European Search Reports dated Nov. 18, 1988; Oct. 8, 1983; Apr. 10, 1995.

*Primary Examiner*—J. R. Scott

*Attorney, Agent, or Firm*—Morgan & Finnegan, LLP

[57] ABSTRACT

A push-type switch 12 with the operation of a switching component 24 through a long extended push component 11 is described. The switch features, in the push direction 13, a push-type guideway and an elastic support which acts against the application of the push. An extended, torsionally and flexurally rigid transmission component 30 is arranged between switching component 24 and push component 11. The transmission component is supported like a flap in a pivotable manner around the axis of a hinge 31. The hinge runs parallel to its transmission component lengthwise direction and crosswise to the direction of the push 13.

11 Claims, 1 Drawing Sheet

PUSH-TYPE SWITCH IN PARTICULAR WITH EXTENDED PUSH COMPONENT

BACKGROUND OF THE INVENTION

1. Field of the Invention

The invention concerns a push-type switch, and the like.

2. Description of the Prior Art

Push-type switches with a manually operated push component through which, in turn, the switching component itself is actuated are commercially available as push buttons and as on/off switches or selector switches. These switches are also known from DE-A 32 40 267. If a push-type switch is equipped with a large but comparatively narrow, greatly extended push-component, either for aesthetic considerations or for operating responses, for example, as a switch for an emergency flasher installation on an automotive dashboard, the switch can easily jam because of the canting of the push-component if the pressure is applied in a non-concentric manner. This may have undesirable consequences, particularly in a marginal situation. Normally one tries to avoid the danger of such an operating failure by providing an especially long straight-line guideway, parallel to the direction of push, hence crosswise to the viewing surface of the push component.

It is true, however, that such a straight-line guideway, penetrating deeply behind the front of the push component, requires a great built-in depth for the entire switch. The space behind the viewing and front surface, however, may not be sufficient for that purpose, in particular in the case of flat housings and especially if switching functions must also be accommodated behind the push component.

SUMMARY OF THE INVENTION

Consequently, the invention addresses the technical problem of providing a push-type switch that will operate without canting, in spite of a greatly extended push component, and that requires as little built-in space as possible.

According to the invention, this is largely achieved by providing between the push component and the switching component a force-transmission component. This force component has a flexurally and torsionally rigid flap, in the nature of a wide single-arm lever. The lever can be pivoted around a hinge, along one of its longitudinal sides, by the actuated push-component.

In other words, whatever the location of the point on the flap along the latter's dimension parallel to the hinge, at which the manual force is applied through the push component; and whatever the location of the point along the flap at which the counter-acting return force of the switching component is applied, the flap will pivot, free of canting, around the hinge, parallel to the latter's lengthwise dimension, i.e., parallel to the lengthwise dimension of the push-component arranged above it; in so doing the flap pushes the switch-component downwards.

It is practical to support the push component against this flap-shaped transmission component by means of several plungers that are offset in relation to each other in a lengthwise direction of the push component. If the application of manual pressure acts in a manner that is eccentric to the operation of the switch, in the vicinity of only a single plunger in particular, in the terminal region of the push component, a region which is particularly critical from a functional viewpoint, the transmission component is flipped away by the pressure transmitted by this plunger. This causes the disappearance of the return force that normally acts against the other plungers, through the transmission component originating from the spring-action-supported switch tappet of the switching component. Because of that, and in spite of the sharply eccentric application of the force, the push component still dips along its entire length, without canting, into the housing front-surface that surrounds it.

Preferably, clamping a rubber-elastic insert into the pressure-transmission path between the push component and the switching component is proposed. This fact in itself is known from DE-A 34 43 988.

So far as further advantageous details of the invention are concerned, we refer to the claims as well as to the specification below and to the summary which concludes it.

BRIEF DESCRIPTION OF THE DRAWING

In the drawing, the following are shown in somewhat simplified manner.

DESCRIPTION OF THE PREFERRED EMBODIMENT(S)

Figure 1:
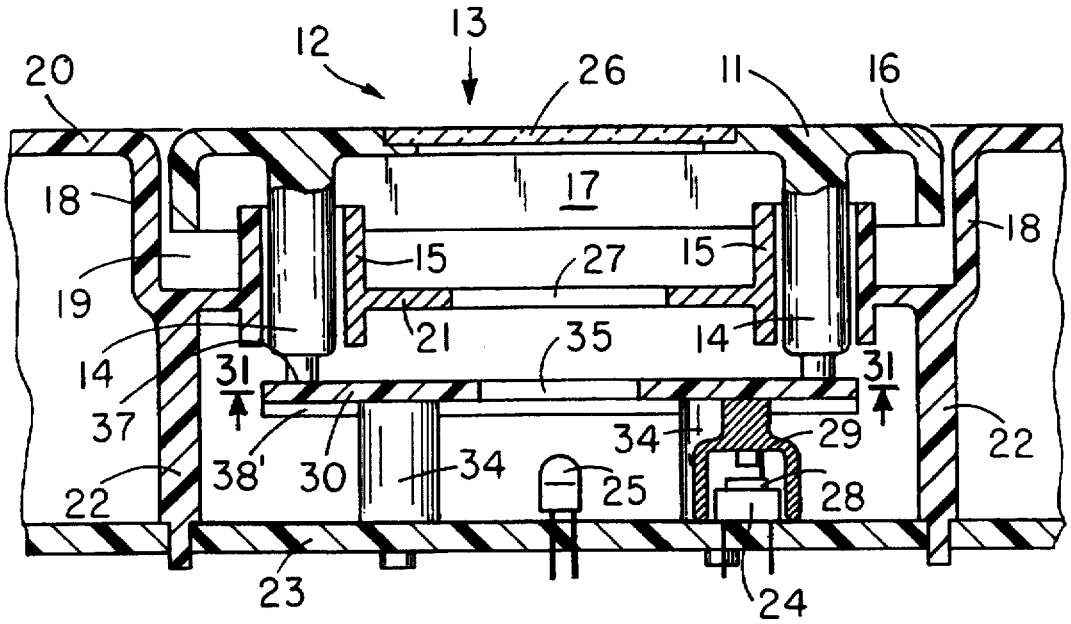
FIG. 1: A push-type switch in section through the lengthwise axis of its push component.
Figure 3:
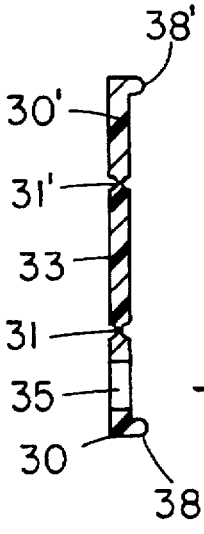
FIG. 3: The arrangement from FIG. 2, in cross section.

As sketched out in the drawing, the push component 11 of a push-type switch 12 for manual operation by applying pressure shows, in the push direction 13, comparatively short straight-line guideways. These extend primarily in the form of plungers 14, parallel to the push direction 13, through guide sleeves 15. The guide sleeves 15 are rigidly connected to the housing. The plungers 14 are each arranged in the vicinity of the narrow margins of the extended pushing surface of the push component 11, behind the latter, preferably formed solidly with it by means of injection molding.

The marginal region 16 of the push component 11, which region surrounds it in the form of a collar, extends, angled toward the push direction 13, into a recess 17 in housing 20, behind the visible front of the housing 20, into which recess the not-yet-operated push-type switch 12 is countersunk and, possibly, flush with the housing 20. In this fashion, the push component 11 receives an additional short straight-line guideway along the adjacent limiting walls 18 of the pot-shaped recess 17 that is in a narrow space 19 between limiting walls 18 and the guide sleeves 15 of the recess 17.

Behind the bottom 21 of the recess 17, a printed-circuit board 23 is supported, illustratively, by means of a threaded-in or molded-in column 22. On the column, frequently in a position which is eccentric with respect to the lengthwise dimension of the push component 11, a pressure responsive electromechanical switch-component 24 is soldered into a printed circuit 23. The switch component 24 has a switch tappet 28 that is operable in the push direction 13. A rubber elastic insert, possibly in the shape of a bonnet 29, clamped into the pressure-transmission path above the switch tappet 28, is used to equalize the built-in tolerances for the pressure-transmission function parts that are arranged above it. The bonnet 29 prevents misfiring by constant spring-action contact with the switch tappet 28. If the bonnet 29, moreover, has preset buckling regions scored in its hollow-cylinder wall and bears on the printed-circuit board 23 on which the switching component 24 is mounted, an additional advantageous consequence is achieved in that the manual operation of the switch occurs with a clear-cut and reproducible cut-in point or clicking point.

In the example shown, the printed-circuit board 23 also carries a source of optical radiation, the light emitting diode 25 behind the push component 11. The push-component features in its central region a cut-in into which is inserted a transparent symbol-carrier 26, a colored disk with an engraved function-symbol, for example. Behind the carrier, in the bottom 21 of the recess 17, which extends between the push component 11 and the printed-circuit board 23, crosswise to the push direction 13, there is provided an opening 27 for the passage of light from the radiation source 25 to the symbol-carrier 26.

Figure 2:
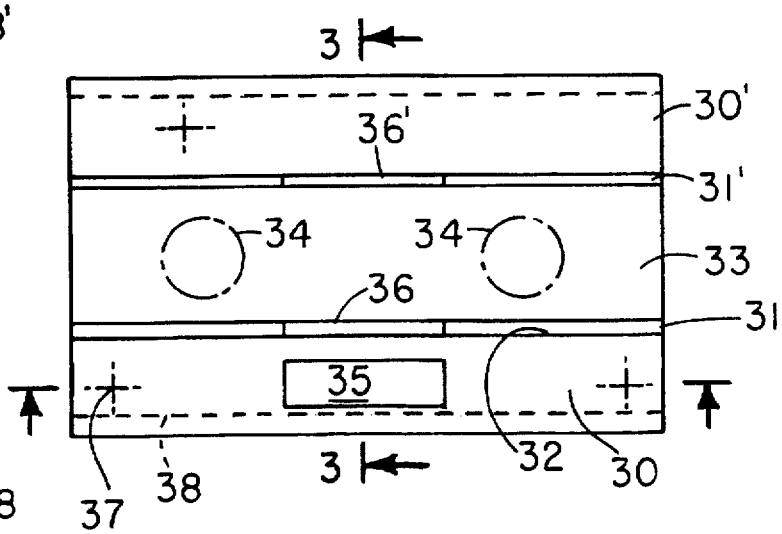
FIG. 2: In top view, two transmission components for extended push-components which push-components are arranged parallel to each other.

When the push switch 12 is operated, its push component bears only indirectly through one of its plungers 14 and the rubber bonnet 29 on the switching component 24, to the extent that in front of the switching component 24 and the rubber bonnet 29 there is included in the circuit an additional flap-shaped transmission component 30. The transmission component 30 can be made more flexurally and torsionally rigid by means of lengthwise ribs 38, 38'. As illustrated, the flap 30 is a wide single-arm lever acting as a pressure intermediate. This transmission component 30, which extends roughly parallel to the push component 11, between the bottom 21 and the circuit board 23, has an extended hinge 31 along one of its lengthwise sides 32 (FIG. 2). The transmission component 30 is articulated to a holder 33 and is able to flip downwards. The holder 33 is supported by means of a distancing screw 34 behind the housing 20, or preferably, in front of the circuit board 23 with reference to the operating-push direction 13. The transmission component 30 and its holder 33 may be produced in one piece through injection molding by, for example, having a weakened pliable film strip for the hinge 31 as a transitional region between the component 30 and the holder 33. By additional weakening in the region of the hinge 31, through extended gaps 36, for example, the bending resistance of the film connection towards the holder 33 can be decreased further. In this manner, the scoring line for the flipping movement along the lengthwise side 32 is more sharply accentuated.

This transmission component 30 also has a cut-in 35 for the passage of light. The cut-in 35 is centered with respect to the radiation source 25, the opening 27 and the symbol-carrier 26.

In the example of the embodiment shown in FIG. 2, a second transmission component 30', disposed in parallel with the first transmission component 30 and intended for an adjacent push-component, is articulated, through its hinge 31', to the central holder 33 in order to provide the desired compactly constructed, overall flat twin push-switch 12.

If, in order to operate the switch, the push component 11 is pushed down in a non-concentric manner, for instance by only applying pressure in the vicinity of one of the plungers 14, shown for example with respect to the plunger 14 at the left of FIG. 1, then, even though the pressure is applied eccentrically, the plunger's pressure point 37 causes the plank-shaped transmission component 30 to flip down over the entire length along its hinge 31. By means of this flipping away of the support, the opposite plunger 14 is released of its load, i.e., it is freed of the counterpressure. Consequently, and in spite of the one-sided application of the pressure, the entire push component 11 now dips in a non-canting manner, parallel to the push direction 13, into the view-side recess 17 in the front of the housing 20. At the same time, the plank-shaped stiff transmission component 30 that flips down along its lengthwise hinge 31 also presses on the switch tappet 28 which, offside from the pressure point 37 which triggered it, is supported below through the rubber bonnet 29, thus pushing the switch tappet 28 into the switching component 24 in order to effect the electromechanical switching procedure.

Consequently, the switching component 24 which, in spite of the elongated push component 11, is of only flat construction because of the short straight-line guideway. The switching component, moreover, can be operated in a reliable, jam-free manner, even if manual force is applied to the push component 11 in a highly eccentric manner.

What is claimed is:

1. A push-type switch for selective activation, comprising a switching component, a lengthwise extended push component moveable in at least one direction generally perpendicular thereto, said push component in said least one direction having a push guideway, an elastic support opposing movement in said direction a lengthwise extended, torsionally and flexurally rigid transmission component interposed between said switching component and said push component, a hinge parallel with said transmission component lengthwise extended direction and crosswise to said push direction for selective flap-like support of said transmission component and plungers abutting said push component, said plungers being offset in relation to each other in said push component lengthwise direction, said plungers bearing against said transmission component.

2. A push-type switch according to claim 1, further comprising a plunger pressure point on said transmission component, a spring-action-supported switch tappet for said switching component, said tappet being offset with respect to said pressure point.

3. A push-type switch according to claim 1 further comprising a holder having a lengthwise side and a film hinge for articulating said lengthwise transmission component to said lengthwise holder side.

4. A push-type switch according to claim 1 further comprising a housing for said push component, a circuit board for accommodating said switching component, and a holder articulated to said transmission component in said push component direction, said holder being supported by said circuit board and said housing having a recess into which the push component can be sunk.

5. A push-type switch according to claim 1, further comprising a housing, margins for said holder, said holder being mounted rigidly on said housing, a plurality of said extended transmission components, a plurality of said push components to each of which is an individual one of said extended transmission components which push components extend parallel to said respective transmission components.

6. A push-type switch according to claim 1, further comprising a housing having a recess formed therein, said plungers traversing said recess in said push component direction, guide sleeves within said housing for said respective plungers to transmit said push component movement to said transmission component, said transmission component being spaced from said push component.

7. A push-type switch according to claim 1, further comprising stiffening ribs for said transmission component.

8. A push-type switch according to claim 1, wherein said transmission component has a recess formed therein, a radiation source for illuminating at least a partial region of the push component through said recess.

9. A push-type switch according to claim 1, further comprising an elastic insert interposed between said push component and said switching component.

10. A push-type switch according to claim 9, further comprising a switch tappet, said elastic insert being a bonnet, said bonnet having a hollow-cylindrical wall to establish a defined buckling characteristic, said bonnet being interposed between said transmission component and said switch tappet, a circuit board for supporting said switching component.

11. A push-type switch for selective activation, comprising a switching component, a plurality of lengthwise extended push component moveable in at least one direction generally perpendicular thereto, said push components in said least one direction having a push guideway, an elastic support opposing movement in said direction, a plurality of lengthwise extended, torsionally and flexurally rigid transmission components interposed between said switching component and said push components, a hinge parallel with said transmission component lengthwise extended direction and crosswise to said push direction for selective flap-like support of said transmission components, a holder having a lengthwise side, a film hinge for articulating said lengthwise transmission components to said lengthwise holder side, and a housing, margins for said holder, said holder being mounted rigidly on said housing, said plurality of push components each of which is individual to a respective one of said extended transmission components, and which push components are parallel to said respective transmission components.

* * * * *